US007607535B2

(12) United States Patent
Jackson

(10) Patent No.: US 7,607,535 B2
(45) Date of Patent: Oct. 27, 2009

(54) CLOTHES CONTAINER WITH AN EXTENDABLE CLOTHES HANGING SYSTEM

(76) Inventor: Holly Katherine Jackson, 961 Pintail Ct., Coppell, TX (US) 75019

( * ) Notice: Subject to any disclaimer, the term of this patent is extended or adjusted under 35 U.S.C. 154(b) by 42 days.

(21) Appl. No.: 11/689,913

(22) Filed: Mar. 22, 2007

(65) Prior Publication Data

US 2007/0256994 A1 Nov. 8, 2007

Related U.S. Application Data

(60) Provisional application No. 60/797,843, filed on May 5, 2006.

(51) Int. Cl.
*A45C 13/02* (2006.01)
*A45C 13/04* (2006.01)
*A45C 13/10* (2006.01)

(52) U.S. Cl. ..... 206/287.1; 190/15 R; 190/24; 190/112; 206/278; 206/287

(58) Field of Classification Search ..... 206/287.1, 206/278, 285–287, 289; 190/13 R, 15 R, 190/24, 112, 127
See application file for complete search history.

(56) References Cited

U.S. PATENT DOCUMENTS 1,520,044 A * 12/1924 Wilt ..... 190/13 R
2,476,932 A * 7/1949 Tucker ..... 206/290
2,639,793 A * 5/1953 Hellman ..... 190/13 R
3,141,535 A * 7/1964 Hamilton ..... 190/13 R
4,267,905 A * 5/1981 Stewart ..... 190/13 R
4,905,826 A * 3/1990 Martin ..... 206/286
4,982,820 A * 1/1991 Scott ..... 190/16
5,065,864 A 11/1991 Schmitt
5,398,807 A 3/1995 Plath
5,458,239 A 10/1995 Plath
5,464,081 A 11/1995 Zwanzig
5,535,880 A 7/1996 Plath
5,732,817 A 3/1998 Plath
D452,378 S 12/2001 Chen
6,481,574 B1 * 11/2002 Pakosh ..... 206/285
6,505,736 B2 1/2003 Donovan
6,874,604 B2 4/2005 Miller et al.
2005/0145458 A1 * 7/2005 Cohen ..... 190/18 A

* cited by examiner

*Primary Examiner*—Sue A Weaver
(74) *Attorney, Agent, or Firm*—Haynes and Boone, LLP

(57) ABSTRACT

A device and method for containing and hanging clothes, according to which the clothes are contained in a body member and a hanging system is manually moved between a retracted position in which it is supported by, and contained in, the body member, and an extended position in which it is supported by, and extends from, the body member. The clothes can be hung on the hanging system in its extended position.

2 Claims, 3 Drawing Sheets

CLOTHES CONTAINER WITH AN EXTENDABLE CLOTHES HANGING SYSTEM

CROSS-REFERENCE TO RELATED APPLICATION

This application claims priority to U.S. provisional patent application No. 60/797,843, filed on May 5, 2006, the disclosure of which is incorporated herein by reference.

BACKGROUND

This invention relates to a clothes container for storing and/or transporting clothes, and more particularly, to such a container having an extendable clothes hanging system.

Containers for storing and transporting clothes, such as suitcases, luggage, valises, trunks, containers, cartons, cases, and the like, are well known. However, none provide for hanging the clothes, although such a need often arises in situations where the clothes need to be displayed, such as at fashion shows, at retailers, or the like, or when the clothes are transported and there is inadequate closet space at the destination.

The present invention addresses this need.

DETAILED DESCRIPTION

Figure 1:
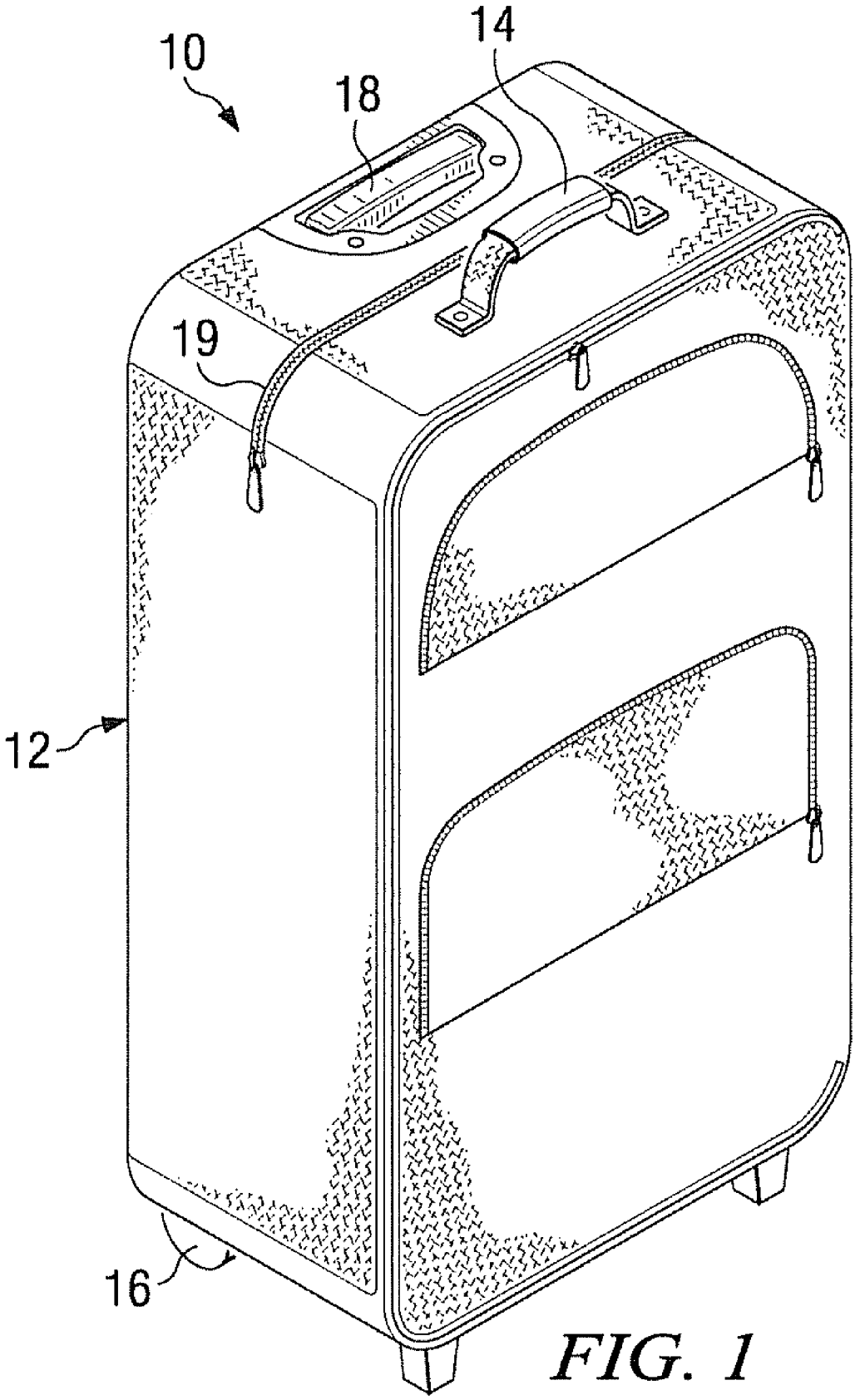
FIG. 1 is an isometric view of a clothes containing device that contains a retracted clothes hanging system (not shown) according to an embodiment of the invention.

Referring to FIG. 1 the reference numeral 10 refers to a clothes containing device for storing and/or transporting clothes, which, for the purpose of example, is shown as being in the form of a suitcase formed by a hollow rectangularly-shaped body member 12. The device 10 includes a handle 14, two rollers (one of which is shown by the reference numeral 16), and an extendable handle 18 that is shown in its retracted position. Although not shown in FIG. 1, it is understood that the body member 12 contains an extendable clothes hanging system, to be describer later, which is retracted and within the confines of the body member. An opening is provided in the wall 12*a* and a zipper 19 extends across the opening to selectively open and close the opening. In the open position the clothes hanging system can be extended out of the body member 12 in a manner to be described.

Figure 2:
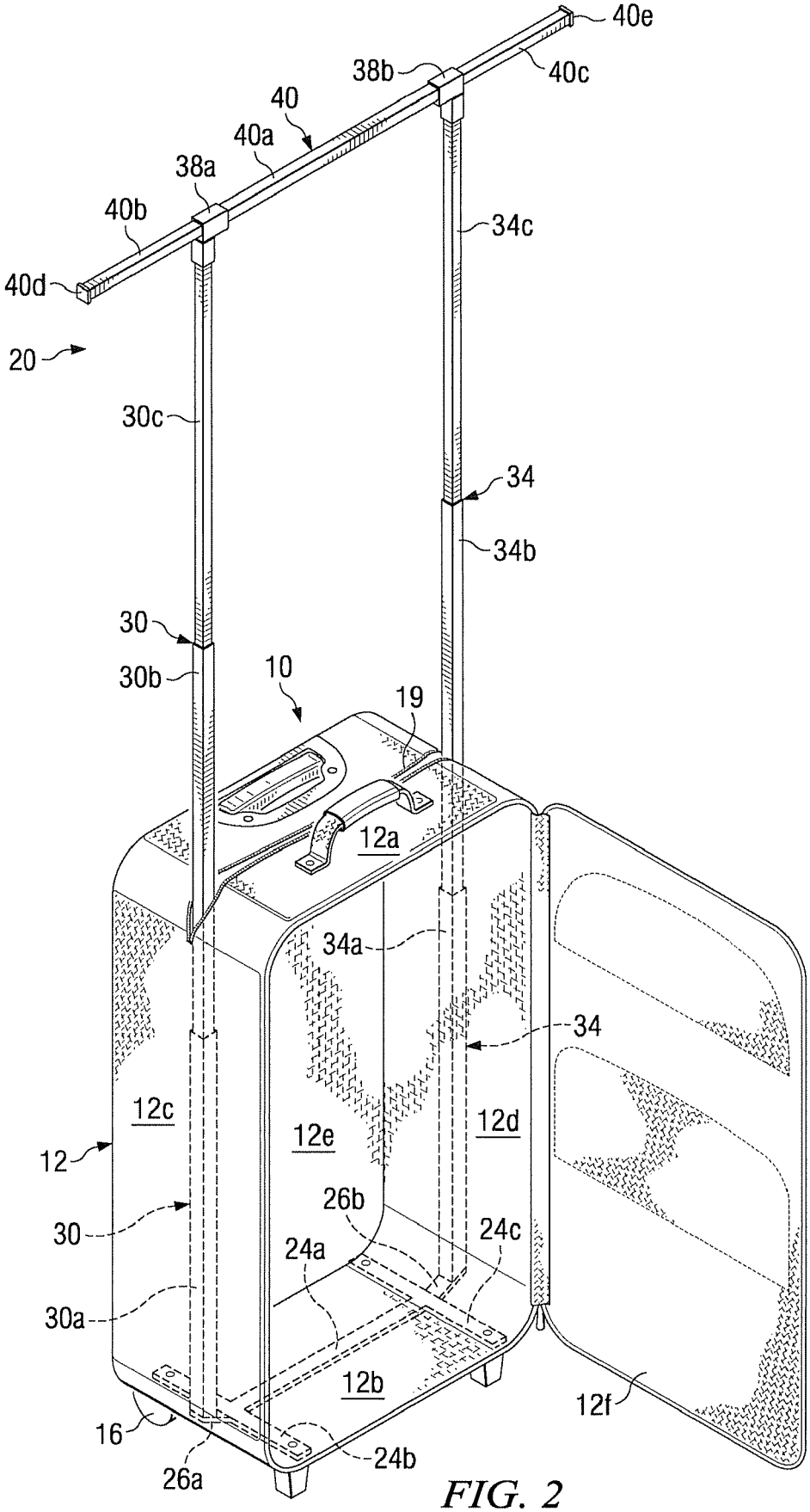
FIG. 2 is a view similar to that of FIG. 1, but depicting the device of FIG. 1 with the clothes hanging system shown in its extended position.

As better shown in FIG. 2, the body member 12 has two end walls 12*a* and 12*b*, two side walls 12*c* and 12*d*, a back wall 12*e*, and a front wall 12*f*. The walls 12*a*-12*e* are formed integrally or are connected in any conventional manner, and the front wall 12*f* is pivotally mounted to the side wall 12*d*. The front wall 12*f* is shown in its closed position in FIG. 1 to form a generally rectangular structure that defines an internal storage area. The front wall 12*f* is shown in its open position in FIG. 2, it being understood that it can be attached to the remaining portion of the body member 12 in any conventional manner, such as by a zipper, or the like (not shown). The corners defined at the junctions of the end walls 12*a* and 12*b* and the side walls 12*c* and 12*d* are curved for aesthetic reasons.

It is understood that the walls 12*a*-12*f* can be constructed of materials well known in the art. For example, one or more of the walls 12*a*-12*f* could consist of ballistic nylon, cloth, leather, or other similar material surrounding a frame consisting of a rigid material, such as metal.

An extendable clothes hanging system according to an embodiment of the invention is supported by the body member 12 and is shown, in general, by the reference numeral 20. The system 20 is shown in its fully extended position in FIG. 2 it being understood that, in its retracted position of FIG. 1, it is completely contained within the interior of the body member 12.

The system 20 consists of a center strut 24*a* extending between two end struts 24*b* and 24*c* to form an Hank-shaped base frame. The ends of the center strut 24*a* can be connected to the inner edges of the struts 24*b* and 24*c*, respectively, at their respective mid-points, or the strut 24*a* can be formed integrally with the struts 24*b* and 24*c*.

Two tabs 26*a* and 26*b* extend from the outer edges of the struts 24*b* and 24*c*, respectively, at their respective mid-points. The tabs 26*a* and 26*b* can be connected to, or formed integrally with, the struts 24*b* and 24*c*, respectively. It is understood that one or more of the struts 24*a*, 24*b*, and 24*c* can be fastened to the aforementioned frame of the end wall 12*b* in any known manner such as by rivets or the like.

A telescoping assembly 30 is provided along the inner side wall 12*c* of the body member 12 and consists of three elongated telescoping members 30*a*, 30*b*, and 30*c*, each having a rectangular cross-section, with the member 30*b* being telescoped in the member 30*a*, and the member 30*c* being telescoped in the member 30*b*. The outermost member 30*a* is fastened to the upper surface of the tab 26*a* and to the aforementioned frame of the side wall 12*c* in any known manner.

A telescoping assembly 34 is provided along the inner side wall 12*d* of the body member 12 and consists of three elongated telescoping members 34*a*, 34*b*, and 34*c*, each having a rectangular cross-section, with the member 34*b* being telescoped in the member 34*a*, and the member 34*c* being telescoped in the member 34*b*. The outermost member 30*a* is fastened to the upper surface of the tab 26*a* and to the aforementioned frame of the side wall 12*d* in any known manner. In their extended position, the members 30*b* and 34*b* project out from the opening in the body member that is normally closed by the zipper 19.

Two rectangularly-shaped support members 38*a* and 38*b* are connected to the respective projecting ends of the members 30*c* and 34*c*, respectively, (the upper ends as viewed in FIG. 2), in any conventional manner. Each support member 38*a* and 38*b* has a transversely-extending, through opening.

A horizontally extending telescoping assembly 40 is also provided and consists of an outer member 40*a*, the respective end portions of which extend within the above openings in the support members 38*a* and 38*b* so that the assembly 40 is supported by the assemblies 30 and 34. The assembly 40 also includes two inner members 40*b* and 40*c* that are telescoped in the respective end portions of the outer member 40*a*. Each member 40*a*, 40*b* and 40*c* has a rectangular cross-section, and two end caps 40*d* and 40*e* are provided on the ends of the members 40*b* and 40*c*.

Although not shown in the drawings, it is understood that the telescoping assemblies 30, 34, and 40 can be provided with detents, or the like, in order to enable the assemblies to be locked in the fully extended positions shown in FIG. 2 or in partially extended positions. Since locking mechanisms of this type are well known in the art, they will not be described in further detail.

Figure 3:
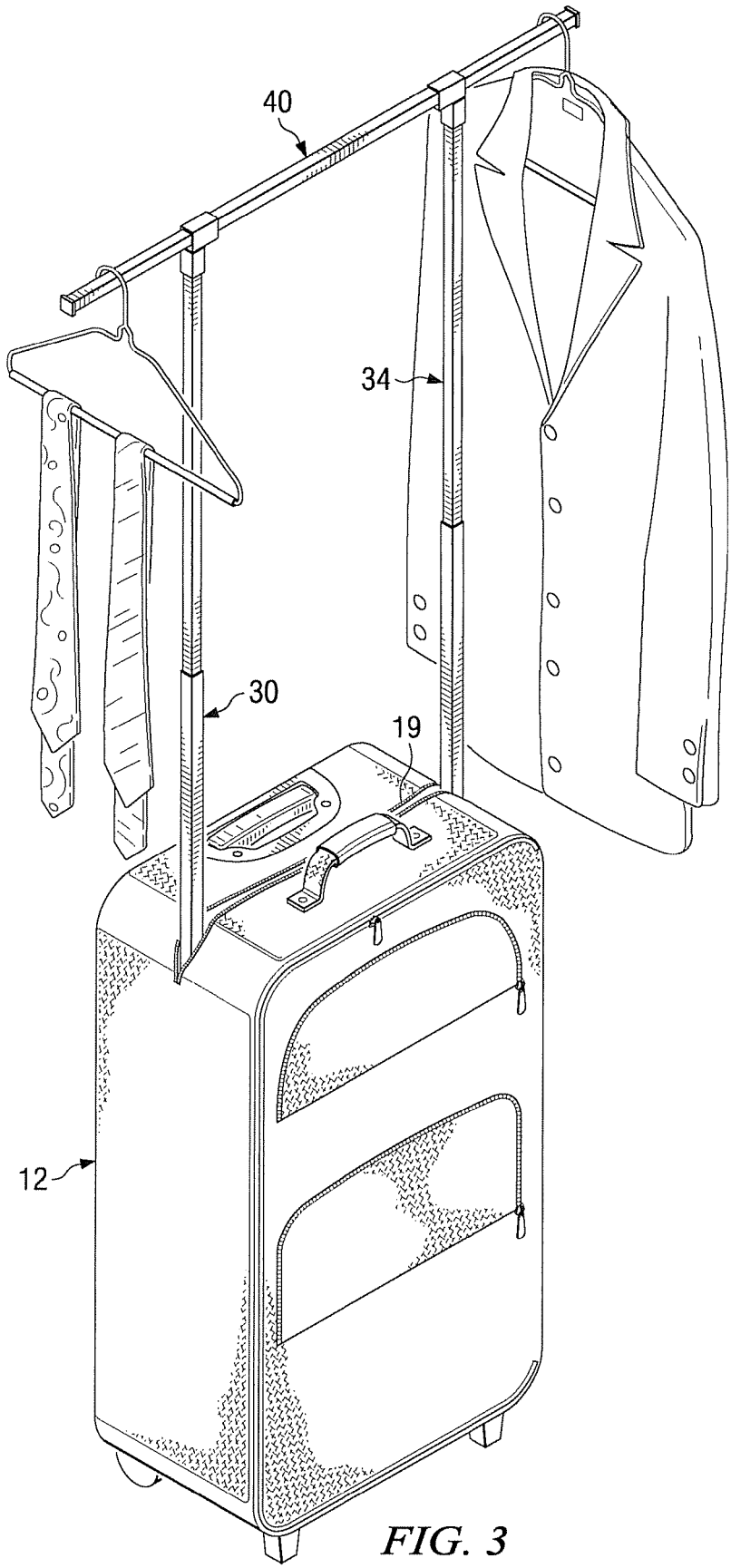
FIG. 3 is a view similar to that of FIGS. 1 and 2, but depicting clothes hung on the extended clothes hanging system.

In operation, and assuming that the system 20 is completely retracted in the body member 12 of the device 10, and that clothes have been stored and/or transported in the aforementioned internal storage area of the body member 12, the zipper 19 is opened to permit manual access to the system 20. The member 40*a* of the assembly 40 is then manually grasped and pulled upwardly, as viewed in the drawings, until the assemblies 30 and 34 expand in the vertical direction and reach their fully or partially extended position. Then the members 40*b* and 40*c* are expanded in a horizontal direction by pulling them out of the member 40*a* until they reach their fully or partially extended position. As shown in FIG. 3, this permits the clothes to be hung on the telescoping assembly 40.

The above embodiment thus provides an extremely convenient way of hanging clothes that are contained in the device 10.

Variations

It is understood that variations may be made in the above, without departing from the scope of the invention. Examples of the variations are as follows:

- The device 10 has been described as a suitcase for the purpose of example only, it being understood that other containers can be used such as, for example, a piece of luggage, a valise, a briefcase, a trunk, a container, a carton, a case, a box, or any other similar device.
- The embodiment described above is not limited to the particular suitcase shown and described above, but rather any other type of suitcase may be used.
- If the design of the body member is such that the tabs 26*a* and 26*b* are not necessary, such as when the junctions between the walls 12*a*-12*d* are not curved, the tabs can be eliminated and the respective ends of the members 30*a* and 34*a* can be attached directly to the struts 24*b* and 24*c*.
- The system 20 can be extended to, and locked in, one or more partially extended position. Also, in one of the partially extended positions, the telescoping assembly 40 could be used as a handle, thus eliminating the need for any type of handle, including the handle 18 in the example discussed above.
- The above embodiment is not limited to "vertical" movement of the telescoping assemblies 30 and 34 and to "horizontal" movement of the assembly 40. Rather, the movements of the assembly 40 are in a plane perpendicular to the plane of movements of the assemblies 30 and 34, and the movements of all the assemblies can be in any direction.
- The above embodiment is not limited to two telescoping assemblies (30 and 34) fastened to the respective side walls of the body member 12 but rather any number of assembles can be fastened along the walls 12*a*-12*e*.
- The number and cross-sectional shape of the telescoping members in each telescoping assembly can be varied.
- The zipper 19 is not necessary as long as an opening is provided in the body member that permits the assembly 20 to move between its retracted and expanded position.

Those skilled in the art will readily appreciate that many other variations and modifications of the embodiment described above can be made without materially departing from the novel teachings and advantages of this invention. Accordingly, all such variations and modifications are intended to be included within the scope of this invention as defined in the following claims. In the claims, means-plus-function clauses are intended to cover the structures described herein as performing the recited function and not only structural equivalents, but also equivalent structures.

What is claimed is:

1. A device comprising:

a suitcase for receiving clothes, the suitcase comprising:
- a base wall;
- an end wall spaced in a parallel relation to the base wall;
- first and second side walls spaced in a parallel relation to each other, each of the first and second side walls being perpendicular to each of the base and end walls;
- at least one handle located on the end wall;
- a zippered opening provided at least in the end wall, the zippered opening comprising open and closed positions; and
- a front wall pivotally mounted to one of the first and second side walls, the front wall comprising open and closed positions, wherein the front wall can be placed in its open and closed positions independently of the placement of the zippered opening in its open and closed positions; and a hanging system for hanging the clothes, the hanging system comprising:
- a base frame coupled to the base wall;
- a first telescoping assembly extending from the base frame and along the first side wall, the first telescoping assembly comprising:
  - a first outer member;
  - a first inner member telescoped in the first outer member and moveable relative to the first outer member; and
  - a first supporting member located at the distal end portion of the first inner member, the first supporting member having a first through opening;
- a second telescoping assembly extending from the base frame and along the second side wall, the second telescoping assembly comprising:
  - a second outer member that is spaced in a parallel relation to the first outer member;
  - a second inner member telescoped in the second outer member and moveable relative to the second outer member; and
  - a second supporting member located at the distal end portion of the second inner member, the second supporting member having a second through opening;
- a third telescoping assembly supported by the first and second telescoping assemblies, the third telescoping assembly comprising:
  - a third outer member wherein:
    - the respective end portions of the third outer member extend within the first and second through openings; and
    - the third outer member is perpendicular to each of the first and second outer members of the first and second telescoping assemblies, respectively; and
  - two inner members, wherein:
    - each of the two inner members is telescoped in the third outer member and is moveable relative to the third outer member; and
    - the two inner members are moveable in opposing directions from each other;
- a retracted position in which:

the zippered opening in the end wall is in its closed position; and the first, second and third telescoping assemblies are contained in the suitcase; and an extended position in which:

the zippered opening is in its open position;

at least respective portions of the first and second inner members are located outside of the suitcase; and the third telescoping assembly is located outside of the suitcase and the two inner members of the third telescoping assembly extend from the third outer member in mutually opposing directions so that the distance between the respective distal ends of the two inner members of the third telescoping assembly is greater than the parallel spacing between the first and second side walls of the suitcase.

2. A method comprising:

providing a suitcase for receiving clothes, comprising:

providing a base wall;

spacing an end wall in a parallel relation to the base wall;

spacing first and second side walls in a parallel relation to each other, each of the first and second side walls being perpendicular to each of the base and end walls;

locating at least one handle on the end wall;

providing a zippered opening at least in the end wall, the zippered opening comprising open and closed positions; and pivotally mounting a front wall to one of the first and second side walls, the front wall comprising open and closed positions, wherein the front wall can be placed in its open and closed positions independently of the placement of the zippered opening in its open and closed positions;

providing a hanging system for hanging the clothes, comprising:

coupling a base frame to the base wall;

extending a first telescoping assembly from the base frame along the first side wall, the first telescoping assembly comprising:

a first outer member;

a first inner member telescoped in the first outer member and moveable relative to the outer member; and a first supporting member located at the distal end portion of the first inner member, the first supporting member having a first through opening;

extending a second telescoping assembly from the base frame along the second side wall, the second telescoping assembly comprising:

a second outer member;

a second inner member telescoped in the second outer member and moveable relative to the second outer member; and a second supporting member located at the distal end portion of the second inner member, the second supporting member having a second through opening;

supporting a third telescoping assembly on the first and second telescoping assemblies, the third telescoping assembly comprising:

a third outer member wherein:

the respective end portions of the third outer member extend within the first and second through openings; and the third outer member is perpendicular to each of the first and second outer members of the first and second telescoping assemblies respectively; and two inner members, wherein:

each of the two inner members is telescoped in the third outer member and is moveable relative to the third outer member; and the two inner members are moveable in opposing directions from each other placing the hanging system in a retracted position in which:

the zippered opening in the end wall is in its closed position; and the first, second and third telescoping assemblies are contained in the suitcase; and placing the hanging system in an extended position in which:

the zippered opening is in its open position;

at least respective portions of the first and second inner members are located outside of the suitcase; and the third telescoping assembly is located outside of the suitcase and the two inner members of the third telescoping assembly extend from the third outer member in mutually opposing directions so that the distance between the respective distal ends of the two inner members of the third telescoping assembly is greater than the parallel spacing between the first and second side walls of the suitcase.

* * * * *